US011846284B1

(12) United States Patent
Zhang et al.

(10) Patent No.: US 11,846,284 B1
(45) Date of Patent: Dec. 19, 2023

(54) SLIDING-POCKET VARIABLE-DISPLACEMENT PUMP WITH COMPENSATION CHAMBERS

(71) Applicant: FORD GLOBAL TECHNOLOGIES, LLC, Dearborn, MI (US)

(72) Inventors: Dengfu Zhang, Northville, MI (US); Akhter uz Zaman, Novi, MI (US); Pablo Davilla, Howell, MI (US); Mark Davis, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/854,063

(22) Filed: Jun. 30, 2022

(51) Int. Cl.
*F04C 14/18* (2006.01)
*F04C 2/344* (2006.01)
*F04C 15/00* (2006.01)

(52) U.S. Cl.
CPC ..... *F04C 14/18* (2013.01); *F04C 2/3446* (2013.01); *F04C 15/0034* (2013.01); *F04C 2240/30* (2013.01)

(58) Field of Classification Search
CPC .... F04C 14/18; F04C 2/3446; F04C 15/0034; F04C 2240/30
See application file for complete search history.

(56) References Cited

U.S. PATENT DOCUMENTS

| | | | | |
|---|---|---|---|---|
| 9,534,595 | B2 * | 1/2017 | Akatsuka | F04C 2/344 |
| 10,119,540 | B2 | 11/2018 | Zhang et al. | |
| 2008/0014108 | A1 | 1/2008 | Schneider | |
| 2020/0141403 | A1 * | 5/2020 | Saga | F04C 14/18 |

FOREIGN PATENT DOCUMENTS

| | | | | |
|---|---|---|---|---|
| CN | 208595056 | U | 3/2019 | |
| EP | 3333381 | A1 * | 6/2018 | F01C 1/344 |
| JP | 2007255276 | A | 10/2007 | |

OTHER PUBLICATIONS

Machine translation of EP-3333381 A1, Hydraulic Device with Sealing Element, Inventors: Uwe et al, Published Jun. 13, 2018. (Year: 2018).*

* cited by examiner

*Primary Examiner* — Mary Davis
(74) *Attorney, Agent, or Firm* — Vincent Mastrogiacomo; Brooks Kushman P.C.

(57) ABSTRACT

A sliding vane pump includes a fixed housing defining inlet and outlet ports and a sliding housing defining a cylindrical cavity and configured to slide within the fixed housing. The fixed housing and the sliding housing define a gap therebetween. A rotor is configured to rotate within the cylindrical cavity and has a plurality of vanes configured to seal against an inner circumferential wall of the cylindrical cavity to define a plurality of pumping chambers. A seal is located in the gap disposed between the fixed housing and the sliding housing to split the gap into first and second compensation chambers. The first chamber is fluidly connected to a first pumping chamber of the plurality of pumping chambers and the second chamber is connected to a second pumping chamber of the plurality of pumping chambers.

18 Claims, 5 Drawing Sheets

SLIDING-POCKET VARIABLE-DISPLACEMENT PUMP WITH COMPENSATION CHAMBERS

TECHNICAL FIELD

This disclosure relates to the field of motor vehicle transmission pumps and more particularly to sliding-pocket variable-displacement vane pumps.

BACKGROUND

Many vehicles are used over a wide range of vehicle speeds, including both forward and reverse movement. Some types of engines, however, are capable of operating efficiently only within a narrow range of speeds. Consequently, transmissions capable of efficiently transmitting power at a variety of speed ratios are frequently employed. When the vehicle is at low speed, the transmission is usually operated at a high-speed ratio such that it multiplies the engine torque. At high vehicle speed, operating the transmission at a low-speed ratio permits an engine speed associated with quiet, fuel-efficient cruising.

SUMMARY

According to one embodiment, a sliding vane pump includes a fixed housing defining inlet and outlet ports and a sliding housing defining a cylindrical cavity and configured to slide within the fixed housing. The fixed housing and the sliding housing define a gap therebetween. A rotor is configured to rotate within the cylindrical cavity and has a plurality of vanes configured to seal against an inner circumferential wall of the cylindrical cavity to define a plurality of pumping chambers. A seal is located in the gap disposed between the fixed housing and the sliding housing to split the gap into first and second compensation chambers. The first chamber is fluidly connected to a first pumping chamber of the plurality of pumping chambers and the second chamber is connected to a second pumping chamber of the plurality of pumping chambers.

According to another embodiment, a sliding vane pump includes a housing defining a first cavity and a seal groove. A slider is disposed in the first cavity and has an outer circumferential wall and an inner circumferential wall that defines a second cavity. The slider defines first and second grooves each extending from the inner wall to the outer wall. The slider and the housing cooperate to define opposing first and second control chambers. A spring is disposed in the first control chamber and is configured to bias the slider to a full-displacement position. The second control chamber is configured to receive pressurized fluid to act against the spring and urge the slider to a low-displacement position. A rotor is configured to rotate within the second cavity and has a plurality of vanes configured to seal against the inner wall to define a plurality of pumping chambers. A seal is disposed in the seal groove and extends between the housing and the outer wall. A first compensation chamber is defined between the housing, the outer wall and the seal. The first compensation chamber is in fluid communication with a first of the pumping chambers via the first groove. A second compensation chamber is defined between the housing, the outer wall, and the seal. The first and second compensation chambers are on opposite sides of the seal and the second compensation chamber is in fluid with a second of the pumping chambers via the second groove.

According to yet another embodiment, a sliding vane pump includes a housing defining a first cavity and a seal groove. A slider is disposed in the first cavity and has an outer circumferential wall and an inner circumferential wall that defines a second cavity. The slider defines first and second grooves each extending from the inner wall to the outer wall. A rotor is configured to rotate within the first cavity and has a plurality of vanes configured to seal against the inner wall to define a plurality of pumping chambers. A seal is disposed in the seal groove and extends to the outer wall. A first compensation chamber is defined between the housing, the outer wall, and the seal and is in fluid with the first groove. A second compensation chamber is defined between the housing, the outer wall, and the seal and is in fluid with the second groove.

DETAILED DESCRIPTION

Figure 1:
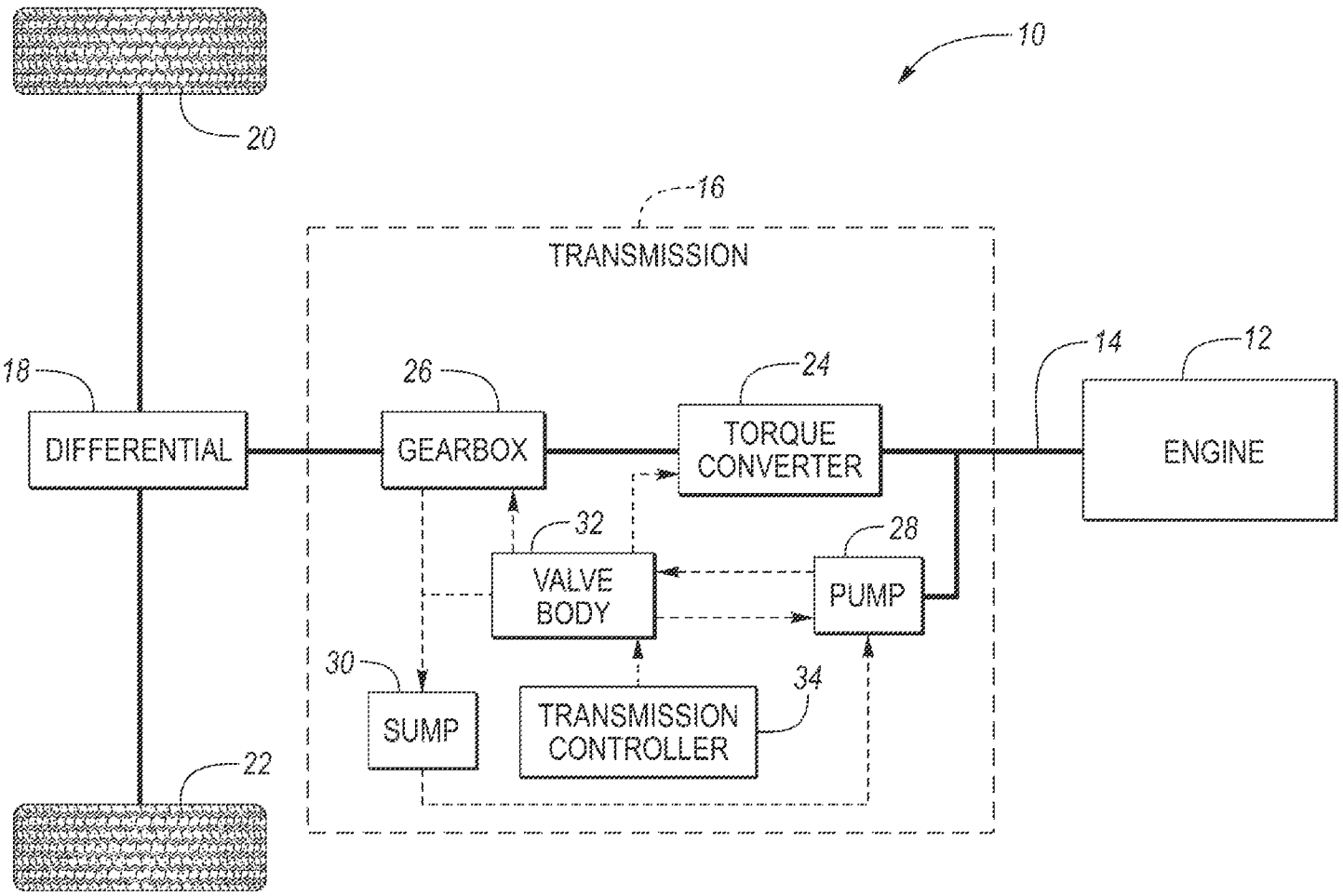
FIG. 1 is schematic diagram of a vehicle powertrain.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Directional terms used herein are made with reference to the views and orientations shown in the exemplary figures. A central axis is shown in the figures and described below. Terms such as "outer" and "inner" are relative to the central axis. For example, an "outer" surface means that the surfaces faces away from the central axis, or is outboard of another "inner" surface. Terms such as "radial," "diameter," "circumference," etc. also are relative to the central axis. The terms "front," "rear," "upper" and "lower" designate directions in the drawings to which reference is made. The terms, connected, attached, etc., refer to directly or indirectly connected, attached, etc., unless otherwise indicated explicitly or by context.

FIG. 1 illustrates a vehicle powertrain system 10. Mechanical power-flow connections are indicated with solid bold lines, the flow of hydraulic fluid is indicated with dashed lines, and the flow of electrical-information signals are indicated with dotted lines. An internal combustion engine 12 (or other powerplant) drives a crankshaft 14 that supplies input power to a transmission 16. The transmission 16 adjusts the speed and torque and delivers the power to a differential 18. The differential 18 divides the power between left and rights wheels 20 and 22 while allowing slight speed differences as the vehicle turns a corner.

Within the transmission 16, the speed and torque are adjusted by a torque converter 24 and a gearbox 26. The torque converter 24 includes an impeller and turbine that transmit power hydro-dynamically whenever the impeller rotates faster than the turbine. It may also include a stator that multiplies the torque. The torque converter may also include a bypass clutch that, when engaged, transmits power mechanically from the impeller to the turbine without the parasitic losses associated with hydrodynamic power transfer. The gearbox 26 includes gearing and clutches arranged such that engaging various subsets of the clutches establish various power flow paths. The different power flow paths have different speed ratios. The gearbox 26 shifts from one speed ratio to another speed ratio by releasing some clutches and engaging other clutches to establish a different power flow path.

The torque converter 24 and gearbox 26 are controlled by adjusting the pressure of hydraulic fluid supplied to various clutches. A pump 28 is driven by the transmission input which is driven by crankshaft 14. The pump 28 draws fluid from a sump 30 and supplies the fluid, at elevated pressure, to valve body 32. The quantity of fluid supplied is based on the engine speed and on a parameter of the pump geometry called pump displacement. As will be described in detail below, the pump 28 is a sliding-pocket variable-displacement vane pump that includes a compensation chamber(s).

The transmission is controlled by a controller 34. In response to signals from the controller 34, the valve body 32 supplies the fluid to the various clutches in the torque converter 24 and the gearbox 26 at controlled pressures less than the pressure supplied by the pump 28. The valve body also supplies fluid to the hydrodynamic chamber of the torque converter 24 and supplies fluid for lubrication to gearbox 26. Fluid travels from the gearbox 26 and the valve body 32 back to the sump 30 to complete the cycle. The quantity of fluid needed varies depending on the current operating state of the transmission. In response to these changes and in response to changes in engine speed, the controller 34 may also direct valve body 32 to adjust the pump displacement to modify output of the pump 28.

Figure 2:
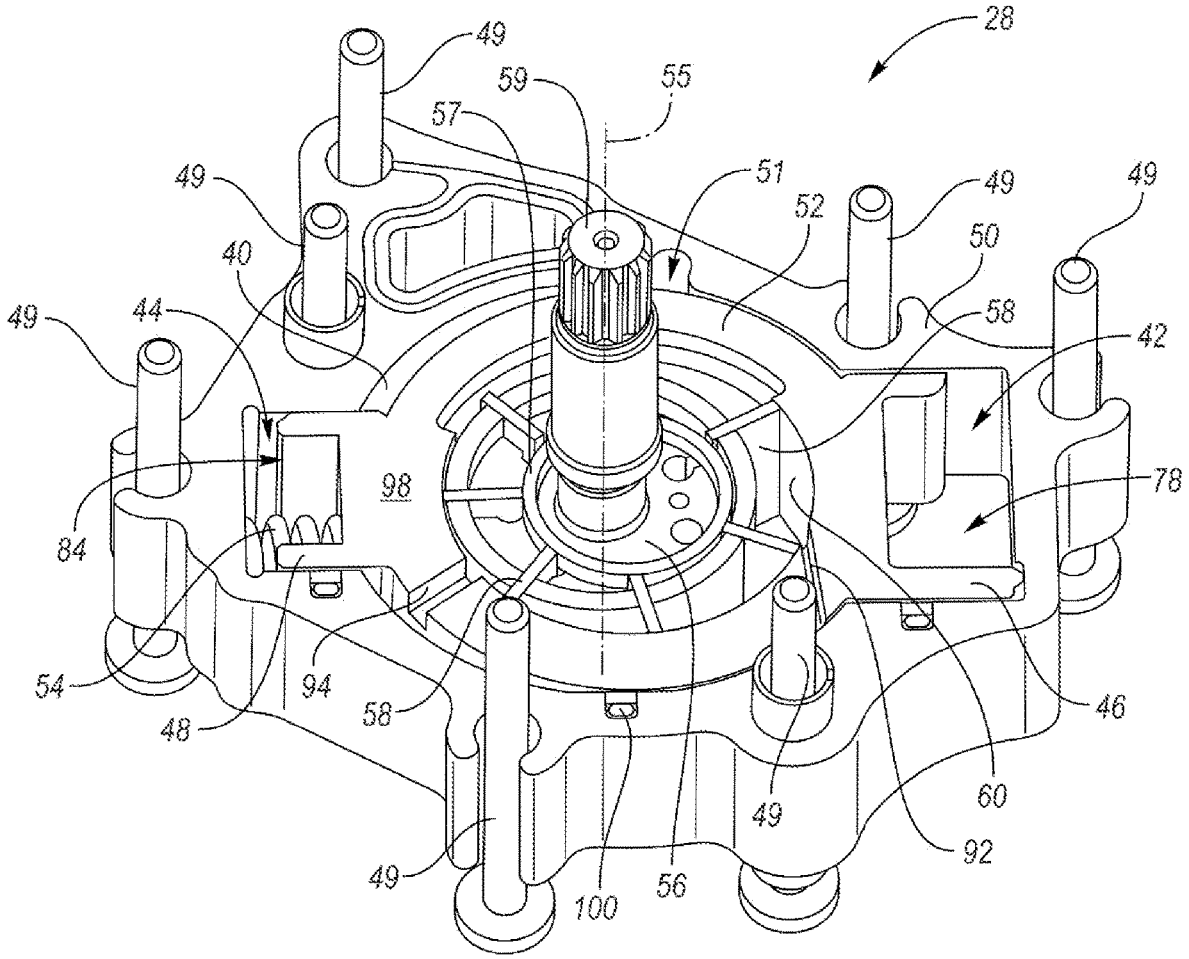
FIG. 2 is a perspective of a sliding-pocket variable-displacement vane pump with the covers removed for illustrative purposes.
Figure 3:
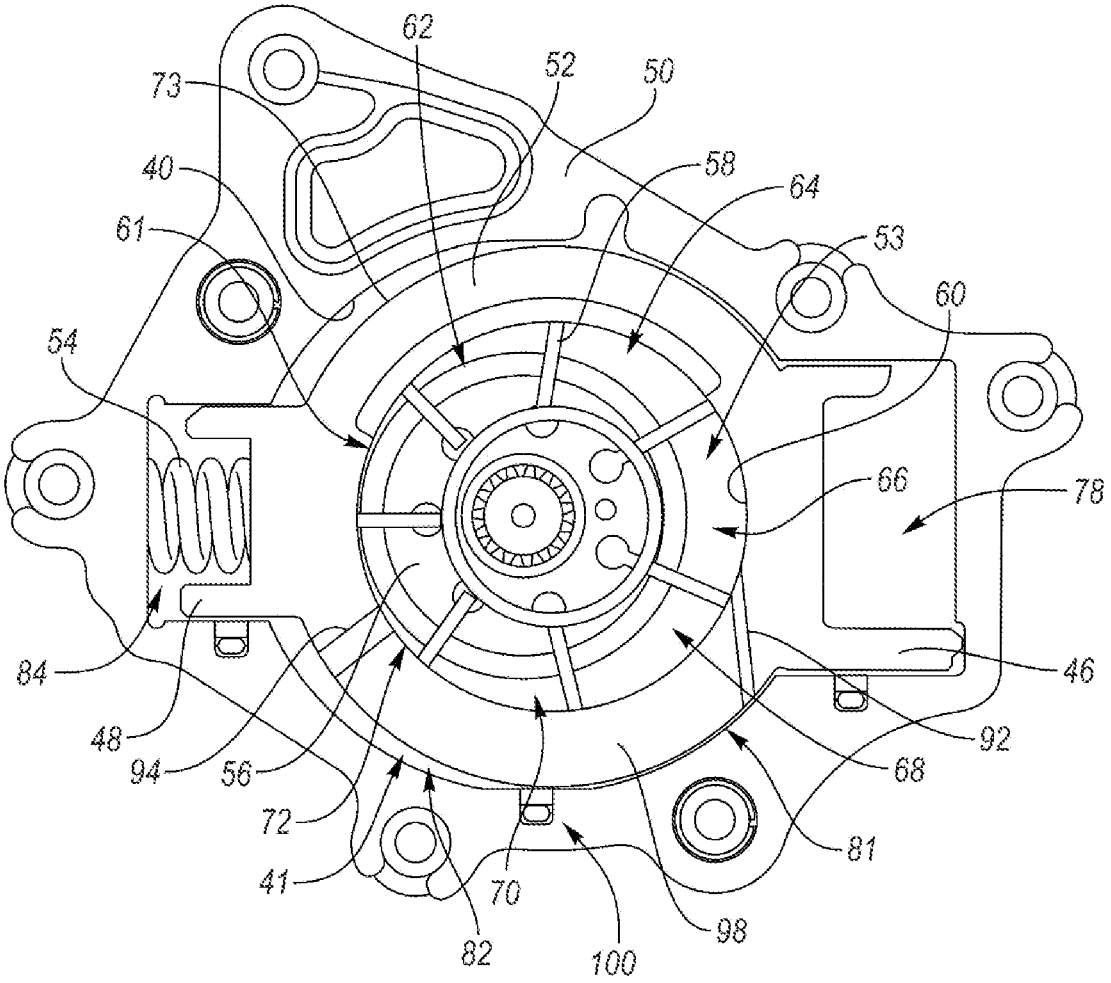
FIG. 3 is a top view of the pump in the full-displacement position.

Referring to FIGS. 2 and 3, the pump 28 is a variable-displacement sliding-pocket vane pump. The sliding vane pump 28 includes a fixed outer housing 50, which may or may not be integrated into a valve body housing. The housing 50 has an inner circumferential wall 40 that defines a cylindrical cavity 51. The inner circumferential wall 40 and the cylindrical cavity 51 are concentric with an axial center line 55 of the pump. The housing 50 may include one or more associated covers (not shown). In the illustrated example, the housing 50 has a top cover and a bottom cover secured to the housing 50 by the shown fasteners 49. In other embodiments, the bottom cover and the housing 50 may be a single unit with a removable top cover.

A sliding housing 52 (also known as a slider) fits within the cavity 51 defined by the outer housing 50. The housing 50 defines recesses 42 and 44 on opposing sides. The slider 52 has projecting portions 46 and 48 that are received in the recesses 42, 44. The distance between bottoms of the recesses 42, 44 is greater than the distance between the tips of the projecting portions 46 and 48 allowing the slider 52 to slide within the cavity 51. Sliding the slider 52 (left and right in the illustrated orientation) changes the displacement of the pump. This pump 28 is in the full-displacement position when slider 52 all the way right and is in the low-displacement position when slid all the way left.

The recesses 42, 44 and the projecting portions 46, 48 cooperate to define control chambers 78 and 84. A spring 54 is disposed in control chamber 84. The spring 54 biases the sliding housing toward the full-displacement position best shown in FIG. 3. The pump 28 is moved to the low-displacement position by supplying fluid to the chamber 78 to compress the spring 54 and slide the slider 52 to the left.

The sliding housing 52 defines a circular interior cavity 53. A rotor 56 rotates within the cavity 53 about the axis 55 that is fixed with respect to the outer housing 50. The rotor 56 is driven by a power source such as the engine 12. The rotor 56 may include an associated shaft 59 that is concentric with the axis. A number of vanes 58 rotate with the rotor 56 such that the tips of each vane follow an inner surface 60 of the circular cavity 53 of sliding housing 52. The vanes 58 are rotationally fixed to the rotor 56 but are radial movable so that the vanes 58 retain in contact with the surface 60 as the eccentricity of the rotor 56 changes due to movement of the slider 52. For example, the vanes 58 may be received in slots defined in the rotor 56. The vanes 58 may be stabilized by a ring 57 that synchronizes the radial sliding of the vanes 58.

The rotor, vanes, and sliding housing collectively define a number of pumping chambers 61, 62, 64, 66, 68, 70, and 72. The volumes of the chambers 61, 62, 64, and 66 increase as the rotor turns clockwise. An inlet port 74 is defined in the outer housing 50 (or a cover of the outer housing), generally underneath the chambers 61, 62, and 64 such that fluid is drawn from the inlet port into the expanding chambers. The volumes of chambers 68, 70, and 72, on the other hand, decrease as the rotor turns clockwise. An outlet port 76 is defined in the outer housing (or a cover of the outer housing) generally underneath the chambers 68, 70, and 72 such that fluid is pushed into the outlet port as the chambers shrink.

The outer circumferential wall 73 of the slider 52 is spaced apart from the inner circumferential wall 40 creating void space 41 on the high-pressure side of the pump 28. A seal 100 is disposed in this void space 41 and splits it to form a first compensation chamber 81 and a second compensation chamber 82. The first compensation chamber 81 generally extends circumferentially from the projecting portion 46 to the seal 100. The second compensation chamber 82 generally extends circumferentially from the projecting portion 48 to the seal 100. As will be discussed in more detail below, the compensation chambers 81, 82 are used to balance forces generated during operation of the pump 28.

Figure 4:
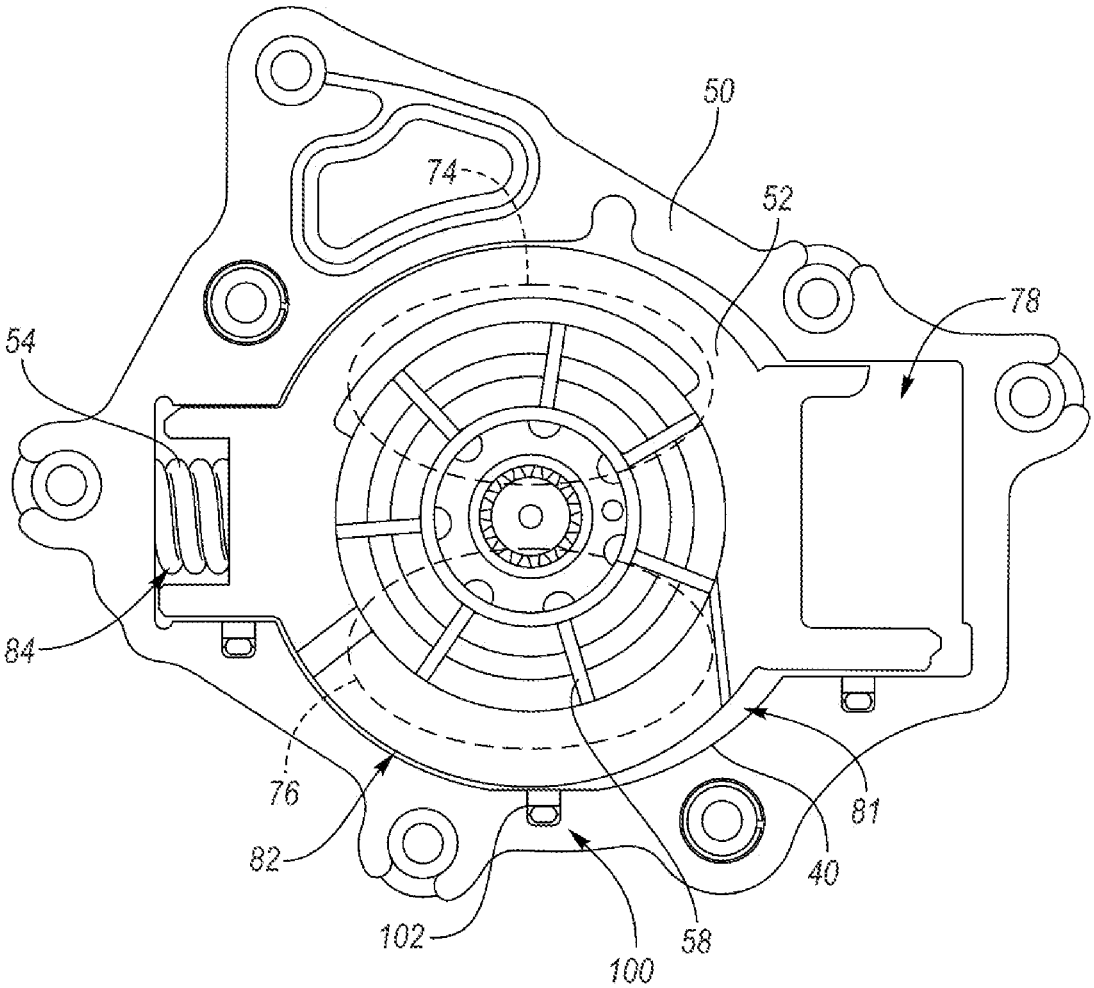
FIG. 4 is a top view of the pump in the low-displacement position.

Referring to FIGS. 3 and 4, when the demand for fluid is low and/or the engine speed is high, the pump 28 is commanded to the low-displacement condition (FIG. 4) by supplying high-pressure fluid to chamber 78. This high-pressure fluid in chamber 78 overcomes the spring force and moves the sliding housing 52 to the left. This decreases the concentricity of the rotor 56 relative to the sliding housing 52 thus decreasing the displacement of the pump 28. In the condition shown in FIG. 4, the volumes of pumping chambers 61, 62, 64, and 66 continues to increase as rotor 56 turns clockwise, but by substantially less than in FIG. 3. Similarly, the volumes of pumping chambers 68, 70, and 72 decreases by substantially less than in FIG. 3. Consequently, the quantity of fluid draw from inlet 74 and pushed into outlet 76 per revolution of rotor 56 is substantially less. When demand for the fluid is high, the pressure commanded to chamber 78 is reduced allowing the spring 54 to urge the sliding housing 52 to the full-displacement condition (FIG. 3).

Pressure differentials within the various chambers may generate unwanted forces, in some operating conditions, that act on the sliding housing 52. These forces may cause the slider 52 to move towards the low-displacement position resulting in reduced pump performance and/or may increase friction between the slider 52 and the fixed housing 50 reducing ease of movement therebetween.

For example, when the pump 28 is rotating quickly, the pressures in chambers 68, 70, and 72 are not equal. Due to entrained air in the fluid, the fluid has non-negligible compressibility. As the chamber moves through the position occupied by chamber 68, the percentage change in volume per degree of rotation is small. Consequently, the pressure in the chamber in that position may be less than the pressure in the outlet port 76. On the other hand, the chamber in the position of chamber 72 has a large percentage decrease in volume per degree of rotation. Therefore, the pressure is higher than the pressure in the outlet port 76. This effect may be particularly strong when the slider 52 is in the full-displacement position and the air content of the fluid is high. The differential pressure between the chambers in these positions results in a net force urging the sliding housing 52 toward the low-displacement position (FIG. 4). At high rotor speeds, this effect may overcome the force of spring 54 causing the displacement to decrease despite a full-displacement command. If the controller had commanded full displacement in response to a high-flow demand, the flow rate produced may fall short of that demand.

In another example, pumping chambers 62, 64, 66, 68, 70, and 72 also exert force on sliding housing 52. In order to push the fluid through downstream flow restrictions, the pressure in the outlet port 76 is higher than the pressure in the inlet port 74. At relatively low speed, the pressure in pumping chambers 62, 64, and 66 is approximately equal to the pressure in inlet port 74 and the pressure in pumping chambers 68, 70, and 72 is approximately equal to the pressure in outlet port 76. These pressures produce a net force in the downward direction of FIG. 3. This net force increases the frictional force between outer housing 50 and sliding housing 52. This frictional force resists movement of the sliding housing 52 when commanded to change position, making the pump unresponsive to small displacement change commands and introducing hysteresis.

The sliding vane pump 28 is designed to address the control issues discussed above. The sliding housing 52 defines grooves 92 and 94 extending from the inner circumferential surface 60 to an outer circumferential surface 73. The grooves 92 and 94 connect the pumping chambers, e.g., 66 and 72, in fluid communication with the compensation chambers 81 and 82. The grooves 92 and 94 may be recessed into a face 98 of the slider 52, such as the face opposite the inlet and outlet ports. The groove 92 may have a width that is less than or equal to a thickness of the vanes 58 so that the groove 92 is only in fluid communication with one pumping chamber at a time. The groove 94 may be wider than the groove 92. Additionally, the groove 94 may be oriented radially relative to the center of the inner circumferential surface 60, whereas the groove 92 may not be oriented radially. As shown in the figures, the groove 92 is oriented at an oblique angle relative to the center of the surface 60. The groove 92 may be placed circumferentially upstream (counterclockwise in FIG. 3) from the timing groove of the pump 28.

The compensation chambers 81 and 82 are separated by the seal 100, which may be seated within a seal groove 102. The seal groove 102 is recessed into the inner circumferential surface 40 of the housing 50. The seal groove 102 may extend in the axial direction of the pump 28. The seal 100 may be a linear seal. The base of the seal is received in groove 102 and the tip of the seal 100 engages with the outer circumferential surface 73 of the sliding housing 52 to separate the compensation chambers 81 and 82.

Figure 5:
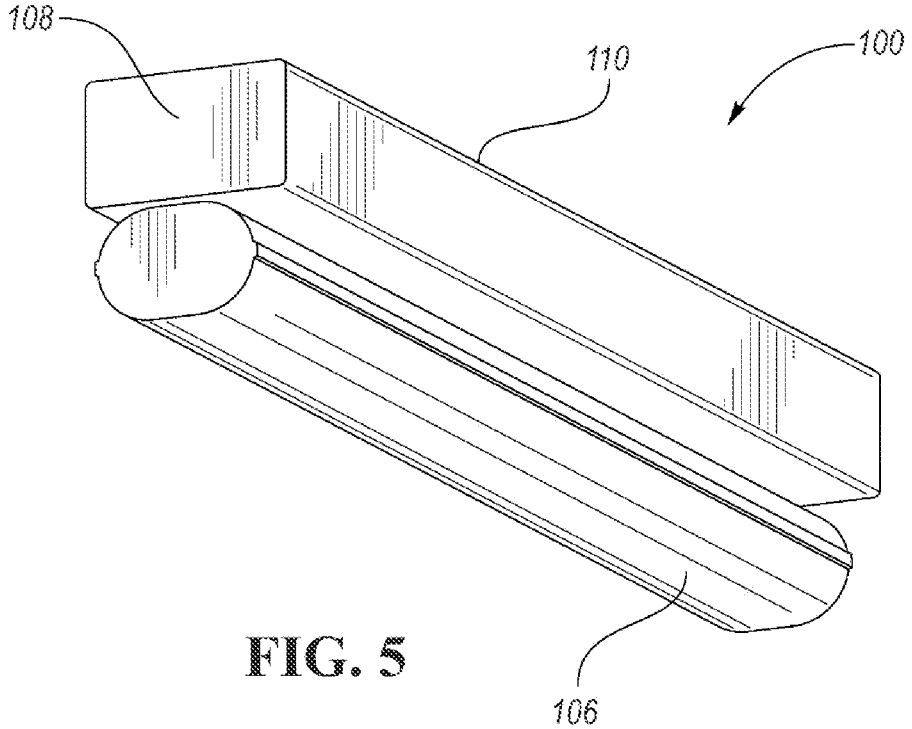
FIG. 5 is a perspective view of a seal for the pump.

Referring to FIG. 5, the seal 100 may be a two-piece assembly that includes an inner seal member 106 and an outer seal member 108. The inner seal member 106 may have a circular cross section, whereas the outer seal member 108 may have a rectangular cross section. The inner seal member 106 may be formed of rubber or other compressible material, whereas the outer seal member 108 may be formed of Teflon, which is generally incompressible. The inner seal member 106 is fully disposed within the seal groove 102. The outer seal member 108 is partially received in the seal groove 102 and projects outwardly therefrom so that the tip 110 of the outer seal 108 engages with the outer circumferential surface 73 of the slider 52.

Referring back to FIG. 3, the groove 94 connects the pumping chamber in the position of chamber 72 to the adjacent chamber 82. Here, an adjacent chamber is a chamber in the same plane as the rotor but on the outside of the sliding housing 52. Groove 92 connects the pumping chamber in the position of chamber 66 to the adjacent side chamber 81.

At all rotor speeds, the pressures inside chambers 81 and 82 generate forces that counter act the above-described forces to inhibit unintended movement of the sliding housing 52 downwardly and to the left (when viewed in the orientation of FIG. 3). Furthermore, at high rotor speed, the chamber 82 is at substantially higher pressure than the chamber 81. This pressure gradient causes a net force on sliding housing 52 biasing it toward the full-displacement position. This force counteracts the force produced by the differential pressures between chambers 66 and 72. Consequently, the sliding housing 52 stays in the full-displacement position until commanded to move and then responds smoothly and proportionately to a command to decrease the displacement. In alternative embodiments, passageways 92 and/or 94 may be formed in a pump cover such that they pass under or over sliding housing 52.

Having two compensation chambers separated by a seal, as shown, has advantages over a single compensation chamber in at least some applications. For example, adding the two chambers 82 and 81 allow for a relatively large pressure differential to be achieved in these two regions, which may result in larger force in the full-displacement direction thus reducing unintended movement (self-regulation) of the sliding housing 52 toward the low-displacement position. The seal 100 also inhibits oil leak through the compensation chambers 81, 82 resulting in greater pump efficiency. The dual-chamber design may also reduce pump pressure ripples.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to strength, durability, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A sliding vane pump comprising:

a fixed housing defining inlet and outlet ports;

a sliding housing defining a cylindrical cavity and configured to slide within the fixed housing, the fixed housing and the sliding housing defining a gap therebetween;

a rotor configured to rotate within the cylindrical cavity and having a plurality of vanes configured to seal against an inner circumferential wall of the cylindrical cavity to define a plurality of pumping chambers; and a seal located in the gap disposed between the fixed housing and the sliding housing to split the gap into first and second compensation chambers; wherein the first chamber is fluidly connected to a first pumping chamber of the plurality of pumping chambers and the second chamber is connected to a second pumping chamber of the plurality of pumping chambers, the first pumping chamber is fluidly connected to the first chamber by a first passageway and the second pumping chamber is fluidly connected to the second chamber by a second passageway, and the first and second passageways have different widths.

2. The sliding vane pump of claim 1, wherein the sliding housing defines the first and second passageways.

3. The sliding vane pump of claim 2, wherein the first and second passageways are grooves recessed into a face of the sliding housing.

4. The sliding vane pump of claim 3, wherein the sliding housing includes an outer circumferential wall in contact with the seal, and the first and second passageways extend from the inner wall to the outer wall.

5. The sliding vane pump of claim 1, wherein the first passageway is oriented radially.

6. The sliding vane pump of claim 5, wherein the second passage is not oriented radially.

7. The sliding vane pump of claim 1, wherein the first passageway is wider than the second passageway, and the second pumping chamber has a second volume greater than a first volume of the first pumping chamber.

8. The sliding vane pump of claim 7, wherein the first passageway is oriented radially and the second passage is not oriented radially.

9. The sliding vane pump of claim 1 further comprising a spring biasing the sliding housing to a position relative to the fixed housing in which a pump displacement is maximum.

10. The sliding vane pump of claim 1, wherein the fixed housing defines an axially extending seal groove and the seal is disposed in the seal groove.

11. The sliding vane pump of claim 10, wherein the seal includes a first seal member completely disposed in the seal groove and a second seal member partially disposed in the seal groove and extending therefrom to contact an outer circumferential wall of the sliding housing.

12. A sliding vane pump comprising:

a housing defining a first cavity and a seal groove;

a slider disposed in the first cavity and having an outer circumferential wall and an inner circumferential wall that defines a second cavity, the slider defining first and second grooves each extending from the inner wall to the outer wall, wherein the slider and the housing cooperate to define opposing first and second control chambers;

a spring disposed in the first control chamber and configured to bias the slider to a full-displacement position, wherein the second control chamber is configured to receive pressurized fluid to act against the spring and urge the slider to a low-displacement position;

a rotor configured to rotate within the second cavity and having a plurality of vanes configured to seal against the inner wall to define a plurality of pumping chambers;

a seal disposed in the seal groove and extending between the housing and the outer wall;

a first compensation chamber defined between the housing, the outer wall and the seal, wherein the first compensation chamber is in fluid communication with a first of the pumping chambers via the first groove; and a second compensation chamber defined between the housing, the outer wall, and the seal, wherein the first and second compensation chambers are on opposite sides of the seal and wherein the second compensation chamber is in fluid communication with a second of the pumping chambers via the second groove.

13. The sliding vane pump of claim 12, wherein the slider has a face, and the first and second grooves are recessed into the face.

14. The sliding vane pump of claim 12, wherein the first groove is wider than the second groove.

15. The sliding vane pump of claim 12, wherein the seal includes a first seal member completely disposed in the seal groove and a second seal member partially disposed in the seal groove and having a tip disposed against the outer wall.

16. A sliding vane pump comprising:

a housing defining a first cavity and a seal groove;

a slider disposed in the first cavity and having an outer circumferential wall and an inner circumferential wall that defines a second cavity, the slider defining first and second grooves each extending from the inner wall to the outer wall;

a rotor configured to rotate within the first cavity and having a plurality of vanes configured to seal against the inner wall to define a plurality of pumping chambers;

a seal disposed in the seal groove and extending to the outer wall;

a first compensation chamber defined between the housing, the outer wall, and the seal and in fluid communication with the first groove; and a second compensation chamber defined between the housing, the outer wall, and the seal and in fluid communication with the second groove.

17. The sliding vane pump of claim 16, wherein the first groove extends from a first of the pumping chambers to the first compensation chamber, and the second groove extends from a second of the pumping chambers to the second compensation chamber, wherein the first and second pumping chambers are located over an outlet port of the pump.

18. The sliding vane pump of claim 17, wherein the first pumping chamber has a volume that is greater than a volume of the second pumping chamber, and wherein the second groove is wider than the first groove.

* * * * *